United States Patent [19]

Hauffe et al.

[11] Patent Number: 4,849,031

[45] Date of Patent: Jul. 18, 1989

[54] PROCESS OF PRODUCING PHOSPHATE COATINGS ON METAL SURFACES

[75] Inventors: Dieter Hauffe, Frankfurt am Main; Gisela Beege, Maintal; Peter Mischke, Frankfurt am Main; Werner Rausch, Oberursel, all of Fed. Rep. of Germany

[73] Assignee: Metallgesellschaft Aktiengesellschaft, Frankfurt am Main, Fed. Rep. of Germany

[21] Appl. No.: 92,951

[22] Filed: Sep. 4, 1987

[30] Foreign Application Priority Data

Sep. 17, 1986 [DE] Fed. Rep. of Germany ..... 3631759

[51] Int. Cl.[4] ..... C23C 22/12

[52] U.S. Cl. ..... 148/260; 427/12; 148/261; 148/262; 148/263

[58] Field of Search ..... 148/6.15 Z

[56] References Cited

U.S. PATENT DOCUMENTS

| | | | |
|---|---|---|---|
| 3,619,300 | 11/1971 | Heller et al. . | |
| 3,660,172 | 5/1972 | Otto . | |
| 3,681,207 | 8/1972 | Russell et al. . | |
| 4,419,199 | 12/1983 | Hauffe | 148/6.15 X |
| 4,595,424 | 6/1986 | Hacias . | |
| 4,673,444 | 6/1987 | Saito | 148/6.15 X |

FOREIGN PATENT DOCUMENTS

| | | | |
|---|---|---|---|
| 0019430 | 11/1980 | European Pat. Off. | 148/6.15 Z |
| 0069950 | 7/1982 | European Pat. Off. . | |
| 0162489 | 4/1985 | European Pat. Off. . | |
| 2159181 | 7/1971 | France . | |
| 2102374 | 8/1971 | France . | |
| 2120644 | 9/1971 | France . | |
| 0204889 | 10/1985 | Japan | 148/61.5 Z |
| 2102839 | 7/1982 | United Kingdom . | |
| 2098242 | 11/1982 | United Kingdom | 148/6.15 X |
| 2157446 | 4/1985 | United Kingdom . | |

OTHER PUBLICATIONS

Galvanotechnik, Band 67, Nr. 1, 15, Jan. 1976; Saulgau, DE; and DD-B-113 027 (G. Krebs) 9/29/82.

*Primary Examiner*—Sam Silverberg
*Attorney, Agent, or Firm*—Felfe & Lynch

[57] ABSTRACT

Disclosed is a process of producing phosphate coatings on surfaces which consist of aluminum or its alloys and of at least one of the materials steel and galcanized steel by spraying or by spraying and dipping. Uniform phosphate layers having a high cover factor are obtained by the use of a phosphating solution which contains about 0.4 to about 0.8 g/l Zn, about 10 to about 20 g/l $P_2O_5$, at least one accelerator and about 80 to about 220 mg/l fluoride ("F(el)"), as determined by a fluoride-sensitive electrode immersed into the bath solution and in which the content of free acid (FA) (in points) has been adjusted to and is maintained at a value corresponding to FA=(0.5 to 1.0)+K wherein K is calculated as K=(0.002 to 0.012)×F(el). The free acid (FA) content is preferably adjusted to and maintained at FA=(0.04 to 0.06)×$C_{P2O5}$+K and the content of free acid (FA) is determined using K=(0.003 to 0.009)×F(el). The process is particularly suitable for preparing the surfaces for being painted, preferably by electrophoretic dip painting.

9 Claims, No Drawings

PROCESS OF PRODUCING PHOSPHATE COATINGS ON METAL SURFACES

BACKGROUND OF THE INVENTION

The present invention is in a process of producing phosphate coatings on surfaces which consist of aluminum or its alloys and of at least one of the materials steel and galvanized steel, wherein said surfaces are treated by spraying or by spraying/dipping with a phosphatizing solution which contains zinc ions, phosphate ions, fluoride ions and an accelerator and the use of the process in preparing the surfaces for an electrophoretic dip painting.

Metal surfaces which consist of aluminum and its alloys and of steel and/or galvanized steel can be phosphatized by being sprayed with zinc phosphate solutions which contain fluoride. Such a phosphatizing treatment has proved satisfactory in the normal-zinc processes in which the phosphatizing solution has a zinc content of, e.g., 2 to 6 g/l.

However, there are considerable difficulties in the use of that technology in the low-zinc spray-phosphatizing processes using a phosphatizing solution which has a zinc content below 1 g/l. One serious problem is that the uniformity and the cover factor of the phosphate coatings formed on the aluminum exhibit considerable variation so that processing cannot be satisfactorily used in practice.

It is an object of the invention to provide a process which is free of the disadvantages mentioned above for the production of phosphate coatings on surfaces consisting of aluminum or its alloys and at least one of the materials steel and galvanized steel and which particularly results in uniform phosphate coatings and can be carried out without a particularly high expenditure regarding the components of the solution and the performance of the process.

SUMMARY OF THE INVENTION

That object is accomplished in that the phosphatizing process is carried out in accordance with the invention in such a manner that the surfaces are contacted with an aqueous phosphatizing solution which contains about 0.4 to about 0.8 g/l Zn, about 10 to about 20 g/l $P_2O_5$, at least one accelerator and about 80 to about 220 mg/l fluoride ("F(el)"), as determined by a fluoride-sensitive electrode immersed into the bath solution and in which the content of free acid (FA) (in points) has been adjusted to and is maintained at a value corresponding to $$FA=(0.5 \text{ to } 1.0)+K$$

wherein K is calculated as $$K=(0.002 \text{ to } 0.012)\times F(el).$$

The aluminum materials which can be treated in the process in accordance with the invention comprise the pure metal and its alloys. Examples of such materials are wrought materials consisting of pure aluminum, AlMg and AlMgSi. A detailed description of the aluminum materials is found, e.g., in Aluminum-Taschenbuch, 14th edition, Aluminum-Verlag, Düsseldorf, 1983.

The term steel is used to describe plain carbon steel to low alloy steel, such as is employed in the form of sheets in making vehicle bodies. The term galvanized steel covers, e.g., steel which has been coated with electrodeposited zinc or has been galvanized by being dipped into a molten bath of zinc and may be covered with zinc or zinc alloys, such as ZnNi, ZnFe, ZnAl.

The process in accordance with the invention is carried out as a spraying process or as a spraying and dipping process. In the spray-dip embodiment, the spraying time must be sufficient to form on the aluminum an at least substantially closed phosphate coating. This usually takes at least 60 seconds. In the spray/dip embodiment the time for dipping is usually in the range of 2 to 5 minutes.

The metal surfaces to be treated must be free from disturbing coverings consisting of oils, lubricants, oxides and the like, which might adversely affect the formation of a satisfactory coating. For that purpose the surfaces are cleaned in a suitable manner. The formation of the phosphate coating is preferably promoted in that the surface is activated with an activating agent known per se, e.g., a titanium phosphate-containing aqueous suspension. The activation is carried out before the phosphate coating is produced. The activating agent may be used in the cleaning bath or in a separate process stage.

The control of the concentrations of zinc and $P_2O_5$ is essential for the formation of phosphate coatings of high quality. If the concentrations are lower than specified, uniform coatings will not be formed. In particular the coating will be less suitable for preparing the surfaces for being painted. Concentrations in excess of the upper limits will also adversely affect the quality as regards a painting operation although the appearance is still satisfactory.

The required concentration of fluoride, which concentration is detected with the fluoride-sensitive electrode, is approximately as high as the content of dissociated (free) fluoride ($F^-$) in the phosphatizing solution. For an adjustment of an F(el) content from 80 to 220 mg/l in a bath having a pH value which is usually employed in low-zinc phosphatizing baths, it is necessary to add about 0.4 to 0.9 g/l $NH_4HF_2$ or equivalent quantities of other simple fluoride conaaining salts. The bath is preferably replenished in that a simple fluoride containing salt is added to the bath in such a quantity that the desired content of F(el) is measured. At least part of the fluoride is added as a simple fluoride.

In addition to the simple fluoride, the phosphating solutions may contain complex fluoride, e.g., of boron or silicon, in the quantities which are usual in phosphatizing technology. Any fluoride which has been released by dissociation will also be detected by the fluoride-sensitive electrode so that it is also contained in the desired value to be adjusted.

The limits of the fluoride content to be detected by the fluoride-sensitive electrode are of essential significance. With an F(el) content below a lower limit of 80 mg/l, the pickling action of the phosphatizing solution will not be sufficient for the formation of uniformly covering phosphate coatings. If the F(el) content exceeds an upper limit of 220 mg/l, the formation of a proper phosphate coating will be disturbed by the concurrent excessive pickling action.

The proper adjustment of the content of free acid (FA) in the phosphatizing solution is of essential significance for the nature of the phosphate coating which is formed. In principle, the free acid content of the phosphatizing solutions used in the process in accordance with the invention is distinctly higher than in the corresponding phosphatizing solutions which contain no fluoride. When fluoride has been added and it is then attempted to maintain the free acid content at the usual value which had existed before the addition of fluoride, the zinc concentration will rapidly decrease and the resulting coatings will be of lower quality.

In the above equation for determining the FA value which is to be adjusted, the lower value in the parentheses is applicable to low concentrations of $P_2O_5$ and the higher value to higher concentrations in the phosphatizing solution. The influence of the measured fluoride activity (F(el)) on the optimum content of free acid is taken into account by the correcting term K. In calculating the term K in the above equation the lower and higher values in parentheses apply to the lower and higher concentrations respectively.

To evaluate the correcting term K, F(el) is expressed in mg/l. To determine the content of free acid (FA), a bath sample of 10 ml is diluted with about 100 ml deionized water and is titrated with 0.1 N NaOH to the end point indicated by a change from dimethyl yellow to a weak yellow color corresponding to a pH value of about 4.25. The FA content in points equals the consumption of sodium hydroxide solution in ml.

One obtains phosphate coatings of particularly favorable quality in a preferred embodiment of the invention in which the metal surface is contacted with a phosphatizing solution in which the content of free acid (FA) has been adjusted to and is maintained at a value corresponding to $$FA=(0.04 \text{ to } 0.06)\times C_{P_2O_5}+K.$$

It will then be found that the required content of free acid is directly related to the $P_2O_5$ concentration ($C_{P_2O_5}$) calculated in g/l. Further improved results can be obtained in another desirable embodiment of the invention, in which the surface is contacted with a phosphatizing solution in which the content of free acid (FA) is determined with $$K=(0.003 \text{ to } 0.009)\times F(el).$$

The accelerator used may consist of the substances which are generally usual in phosphatizing technology. It will be of special advantage to contact the surface with an aqueous phosphatizing solution which contains an accelerator consisting of chlorate, bromate, nitrate, nitrite, peroxide and/or organic nitro compounds, such as meta-nitrobenzenesulfonate. These accelerators can be used in the usual quantities.

In another desirable embodiment of the invention, the phosphate coatings are produced by contacting the surface with an aqueous phosphatizing solution which contains in addition one or more cations of the group Ni, Mn, Mg, and Ca, preferably in an amount of 0.1 to 1.5 g/l.

A portion of these cations is incorporated in the phosphate coating and under special conditions may improve the coating quality.

Additional known additives can be added to the phosphatizing solution to modify the processing and the properties of the layer. Such additives may consist of, e.g., surfactants, polyhydroxycarboxylic acids, polyphosphates, ammonium ions, alkali ions, copper ions, cobalt ions and indifferent anions, such as chloride and sulfate.

The phosphatizing solution when contacting the metal surface is usually at a temperature of from 40° to 60° C. and the spraying time is between 1 and 3 minutes.

The phosphate coatings produced by the process in accordance with the invention have a weight of about 1 to 5 g/m$^2$ and can be used in all fields in which phosphate coatings are employed. A particularly desirable use is in the preparation of the metal surfaces to be painted, particularly by electrophoretic dip painting.

The invention will now be explained more in detail and by way of example in the following Examples.

EXAMPLES

Four series of composite sheets having surfaces consisting of $AlMg_3$ and steel, $AlMg_3$ and galvanized steel, AlMgO.4Sil. 2 and steel and AlMg0.4Sil. 2 and galvanized steel were degreased at 50° C. by being sprayed with an activating, mildly alkaline cleaning liquor for 2 minutes and were then rinsed with water and subsequently phosphatized with the following phosphatizing solutions applied by spraying for 2 minutes:

| | | A | B | C |
|---|---|---|---|---|
| Zn | (g/l) | 0.7 | 0.5 | 0.6 |
| Ni | (g/l) | 0.8 | 0.2 | — |
| Mn | (g/l) | 1.2 | — | — |
| $P_2O_5$ | (g/l) | 15 | 15 | 15 |
| F(el) | (mg/l) | 130 | 120 | 150 |
| F(total) | (mg/l) | 350 | 350 | 420 |
| $NO_3$ | (g/l) | 3.0 | 2.5 | 3.0 |
| Na | | In the quantity required to adjust the free acid content | | |
| $NaNO_2$ | (g/l) | 0.1 | 0.1 | 0.1 |
| FA | | 1.3 | 1.2 | 1.4 |
| TA* | | 21.6 | 21.2 | 21.0 |

*Total Acid. 10 ml phosphatizing solution is titrated with 0.1N NaOH using phenolphtalein as an indicator. TA equals the consumption of NaOH in ml.

* Total Acid. 10 mi phosphatizing solution is titrated with 0.lN NaOH using phenolphtalein as an indicator. TA equals the consumption of NaOH in ml.

The phosphated sheets are rinsed with water, afterrinsed with a Cr(VI)-containing passivating solution, sprayed with dionized water and dried.

With all phosphatizing solutions A, B and C, uniformly covering phosphate coatings were formed on the sheets of all four series and were well suited for a succeeding electrophoretic dip painting.

It will be understood that the specification and examples are illustrative but not limitative of the present invention and that other embodiments within the spirit and scope of the invention will suggest themselves to those skilled in the art.

What is claimed is:

1. A process of producing phosphate coatings on surfaces which consists of aluminum or its alloys and of at least one of the materials steel and galvanized steel comprising: contacting said surfaces by spraying or spraying/dipping with a phosphatizing solution containing about 0.4 to about 0.8 g/l Zn, about 10 to about 20 g/l $P_2O_5$, at least one accelerator and about 80 to about 220 mg/l fluoride (F(el)), measuring F(el) by a fluoride sensitive electrode, the solution having a free acid (FA) content maintained at a value corresponding to $$FA=(0.5 \text{ to } 1.0)+K$$

wherein K is calculated as $$K=(0.002 \text{ to } 0.012)\times F(el).$$

2. The process of claim 1 wherein the surfaces are contacted with an aqueous phosphatizing solution in which the content of free acid (FA) is determined with $$K=(0.003 \text{ to } 0.009)\times F(el).$$

3. The process of claim 1 wherein the surfaces are contacted with the aqueous phosphatizing solution which contains one or more accelerators selected from the group consisting of chlorate, bromate, nitrate, nitrite, peroxide and an organic nitro compound.

4. The process of claim 3 wherein the organic nitro compound is meta-nitrobenzene sulfonate.

5. The process of claim 1 wherein the surfaces are contacted with the aqueous phosphatizing solution which additionally contains one or more cations of the group Ni, Mn, Mg, and Ca.

6. The process of claim 5 wherein the one or more cations is present in the solution in an amount of 0.1 to 1.5 g/l.

7. A method of preparing a surface to be painted comprising: applying a phosphatizing coating to the surface according to claim 1.

8. The method of claim 7 wherein the coated surface is painted by electrophoretic dip painting.

9. A process of producing phosphate coatings on surfaces which consists of aluminum or its alloys and of at least one of the materials steel and galvanized steel comprising: contacting said surfaces by spraying or spraying/dipping with a phosphatizing solution containing about 0.4 to about 0.8 g/l Zn, about 10 to about 20 g/l $P_2O_5$, at least one accelerator and about 80 to about 220 mg/l fluoride (F(el), measuring F(el) by a fluoride sensitive electrode, the solution having a free acid (FA) content maintained at a value corresponding to $$FA=(0.04 \text{ to } .0.06)\times C_{P_2O_5}+K$$

wherein K is calculated as $$K=(0.002 \text{ to } 0.012)\times F(el).$$

* * * * *

UNITED STATES PATENT AND TRADEMARK OFFICE

CERTIFICATE OF CORRECTION

PATENT NO. : 4,849,031

DATED : July 18, 1989

INVENTOR(S) : Dieter Hauffe et al

It is certified that error appears in the above-identified patent and that said Letters Patent is hereby corrected as shown below:

Column 4, lines 36 to 38, delete "*Total acid...in ml"

Cover sheet, [30], Foreign Application Priority Data should read --Sep. 18, 1986--, not "Sep. 17, 1986"

Signed and Sealed this

Nineteenth Day of June, 1990

*Attest:*

HARRY F. MANBECK, JR.

*Attesting Officer*

*Commissioner of Patents and Trademarks*